United States Patent [19]

Henriksson

[11] Patent Number: 4,678,109

[45] Date of Patent: Jul. 7, 1987

[54] TRACTOR MECHANISM FOR PRINTERS

[75] Inventor: Bengt-Ake Henriksson, Svangsta, Sweden

[73] Assignee: Telefonaktiebolaget L M Ericsson, Stockholm, Sweden

[21] Appl. No.: 795,343

[22] PCT Filed: Feb. 15, 1985

[86] PCT No.: PCT/SE85/00079

§ 371 Date: Oct. 10, 1985

§ 102(e) Date: Oct. 10, 1985

[87] PCT Pub. No.: WO85/03671

PCT Pub. Date: Aug. 29, 1985

[30] Foreign Application Priority Data

Feb. 17, 1984 [SE] Sweden ..... 8400857

[51] Int. Cl.[4] ..... B41J 11/26; B65H 20/20

[52] U.S. Cl. ..... 226/74; 226/92

[58] Field of Search ..... 226/62, 68, 74, 75, 226/91, 92, 6, 169, 170, 172; 271/245–247; 400/595, 613.1, 616–616.3

[56] References Cited

U.S. PATENT DOCUMENTS

| | | | |
|---|---|---|---|
| 3,825,162 | 7/1974 | Hubbard | 226/74 |
| 4,003,647 | 1/1977 | Kuppens | 226/62 X |
| 4,203,335 | 5/1980 | Coffey | 226/62 X |
| 4,251,162 | 2/1981 | Krammerer et al. | 226/76 X |
| 4,304,345 | 12/1981 | Carlin | 226/74 |
| 4,412,637 | 11/1983 | Berger | 226/74 X |

FOREIGN PATENT DOCUMENTS 197184 12/1982 Japan .

*Primary Examiner*—Stuart S. Levy
*Assistant Examiner*—Lynn M. Sohacki
*Attorney, Agent, or Firm*—Burns, Doane, Swecker & Mathis

[57] ABSTRACT

Tractor mechanism for paper traction feed printers and typewriters, said mechanism including in a holder (2) an endless belt (8) which is mounted for movement in its endless direction, as well as a drive connection for the belt. The belt has external teeth (10) intended to drive a printing medium such as a paper web or the like through the printer on movement of the belt by engagement with a row of holes along an edge of the medium. The holed edge and the toothed belt run in a gap defined by two wall portions of the holder the height of the gap being less than at the height of the teeth plus the thickness of the belt and the wall portion facing towards the teeth has a groove (26) for the teeth. The holder (2) carries a printing medium insertion means with a feeder (32) which, form an extended printing medium engagement position, in which a hole engagement means (58) carried by the feeder is brought into engagement with a part of the row of holes in the printing medium intended for insertion in the gap, is movable together with the printing medium to a drawn-in position in which a plurality of holes in the row of holes are brought into engagement with teeth (100 in the gap. Moving means are disposed in connection with the drawn-in position to move the hole engagement means (58) out of engagement with the row of holes.

10 Claims, 4 Drawing Figures

TRACTOR MECHANISM FOR PRINTERS

TECHNICAL FIELD

The present invention relates to a device in tractor mechanisms for paper traction feed printers and typewriters, this mechanism containing in a holder an endless belt, which is mounted for movement along its endless direction, as well as a drive connection for the belt, which belt has external teeth intended to drive a printing medium such as a paper web or the like through the printer on movement of the belt, by engagement with a row of holes along an edge of the medium, the holed edge and the toothed belt running in a gap defined by two wall portions of the holder, the height of the gap being less than the height of the teeth plus the thickness of the belt, with the wall portion facing towards the teeth having a groove for them.

BACKGROUND ART

Such a tractor mechanism is known, inter alia from the U.S. Pat. No. 3,825,162. For advancing a paper web in one direction through a printer there are two tractor mechanisms of this kind arranged with their respective holders movable on two parallel, horizontal rods, of which one is a drive shaft. More specifically, the toothed belt in each tractor mechanism runs over two rollers mounted in the holder, the drive shaft being in driving engagement with one of the wheels by the above-mentioned drive connection. The printer contains a motor which rotates the drive shaft.

Of the holders, the grooved wall portion is situated on a pivotable lid, the gap and the portion of the toothed belt running through it being uncovered by raising the lid. With the lids pivoted the paper web is brought in between the tractor mechanisms with both its holed edges in engagement with the toothed belt of the respective mechanism, subsequent to which the lids are repivoted. The paper is then securely held for advancing through the gaps in the tractor mechanisms.

A problem with printers provided with tractor mechanisms of the kind described above is that the mechanisms in certain cases may be located comparatively inaccessibly in the printer, so that inserting the paper by pivoting up the lids is made difficult. This problem is particularly apparent in types of printers where each tractor mechanism has two mutually opposing gaps on either side of the holder, these gaps being of the kind mentioned above with associated lids, the paper web running through both gaps and thus engaging twice with each toothed belt. The advantage of this type of paper feeding is that it facilitates movement of the paper web in the reverse direction. With relation to insertion of the paper, however, one of the gaps is usually situated considerably more inaccessibly than the other, e.g. under it.

DISCLOSURE OF INVENTION

The object of the invention has been to solve the above-mentioned problems and to provide, in tractor mechanisms of the kind described in the introduction, a device which considerably simplifies inserting the printing medium in the printer.

The foundation of the invention lies in the knowledge that insertion of the printing medium is considerably simplified if it can be fed into the tractor mechanism in the running direction of the toothed traction belts without needing to pivot the lids. More specifically, the above-mentioned object has been achieved by a device of the kind mentioned in the introduction having been given the characterizing features disclosed in claim 1.

Advantageous embodiments of the invention have been given the characterizing features disclosed in the respective subclaims.

BRIEF DESCRIPTION OF DRAWINGS

The invention will be described in detail below with reference to the accompanying drawings on which FIG. 2 is an exploded view of this device, while

BEST MODE FOR CARRYING OUT THE INVENTION

In the following description, terms such as "right", "left", "upper", "lower" are used with reference to the orientation of different details of the tractor mechanism in the positions illustrated on the drawings. It will be understood that the situation of these details can be described entirely differently if the tractor mechanism assumes other positions in practice.

Figure 1:
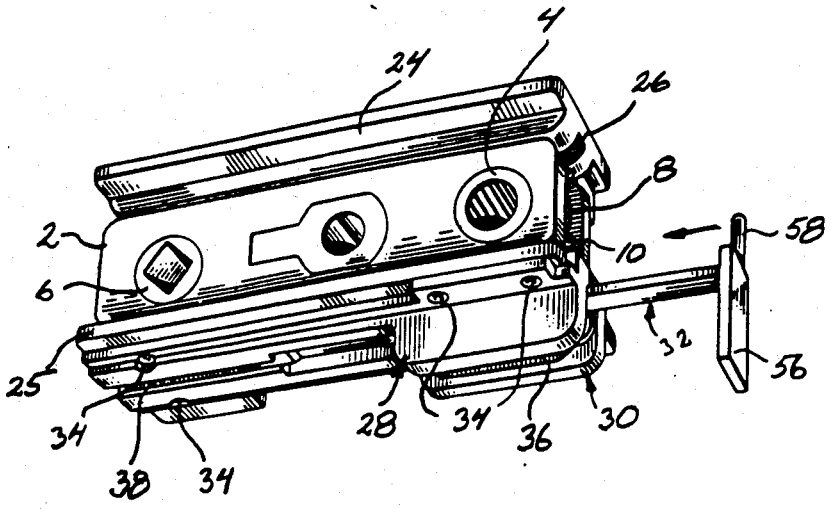
FIG. 1 illustrates in perspective a tractor mechanism for a traction feed printer, equipped with a device in accordance with the invention.
Figure 3:
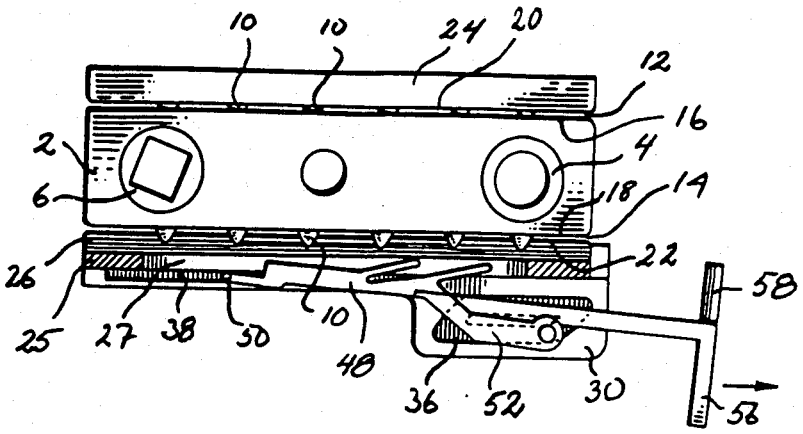
FIGS. 3 and 4 illustrate in side view, with a portion of the device removed, two different working positions for a moving part included in the device.
Figure 4:
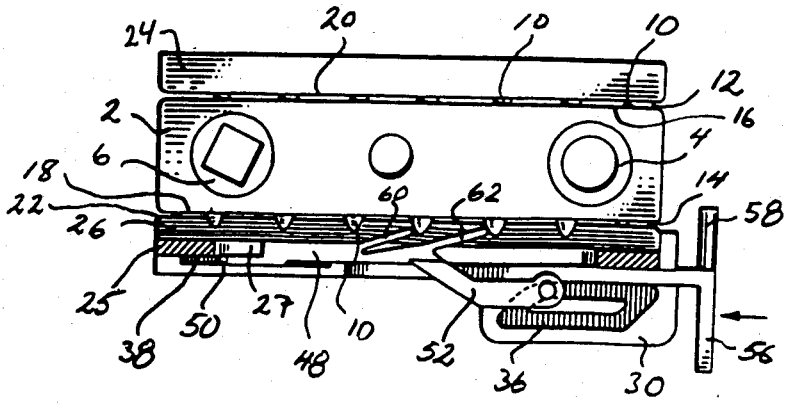

The tractor mechanism, merely schematically illustrated in FIGS. 1, 3 and 4, includes a holder 2, in which are mounted two rollers, one on a hollow journalling shaft 4 and the other on an accompanying shaft 6 with a central square hole. An endless belt provided with uniformly distributed external teeth 10 runs over the rollers, and only a small portion of the belt is visible at 8 in FIG. 1. The pitch of the teeth is more specifically the same as that in a row of holes in a printing medium which is to be advanced by the tractor mechanism. In a similar way as described in the U.S. Pat. No. 3 825 162, for example, the holes in the elements 4 and 6 are intended to receive the parallel rods of a traction feed printer, these rods carrying two tractor mechanisms. One of these rods forms a rotatable drive shaft which is in driving engagement with the shaft 6 via the square hole.

The teeth 10 are intended to drive an unillustrated printing medium such as a paper web or the like, through the printer on movement of the belt, by engagement with a row of holes along an edge of the medium. More specifically, the holed paper edge and the toothed belt 8 run in two gaps 12 and 14 on either side of the holder 2, these gaps being defined on one side by a wall part 16 and 18 and on the other side by a wall part 20 and 22 of the holder. The wall parts 20 and 22 are situated on a pivotable lid 24 and 25, respectively, such that when the lid is pivoted the toothed belt 8 in the respective gap 12 and 14 is uncovered. The height of the gaps 12 and 14 is less than the height of the teeth 10 plus the belt thickness, as will be seen from FIGS. 3 and 4, the lids 24 and 25 having a groove 26 for accommodating the teeth, in the bottom of the groove there being a slot 27 through the lid (FIGS. 3, 4).

As so far described, the embodiment of the tractor mechanism is conventional, and the above-mentioned American Patent Specification is referred to as an example, or with reference to the embodiment with two gaps, reference is made to such constructions common on the market.

The further discussion below will relate to the embodiment of the device in accordance with the invention.

The lid 25 carries a printing medium insertion means comprising two elongate side pieces 28, 30 attached to the lower side of the lid 25, with a movable element 32 between them called "feeder" below. The side pieces 28, 30 are more specifically attached to the lid 25 with the aid of screws 34 and are formed to mutual opposite hand in a manner described in detail below.

Each side piece 28, 30 has two guide grooves for guiding the movement of the feeder 32. More specifically, each side piece has at one end a parallellogram-shaped guide groove 36 in an downwards wall portion, and in the other end a straight guide groove 38. On the drawings there are only visible the guide grooves 36 and 38 of one side piece 30. In the side views according to FIGS. 3 and 4 the side piece 28 furthermore has been removed for the sake of clarity.

Figure 2:
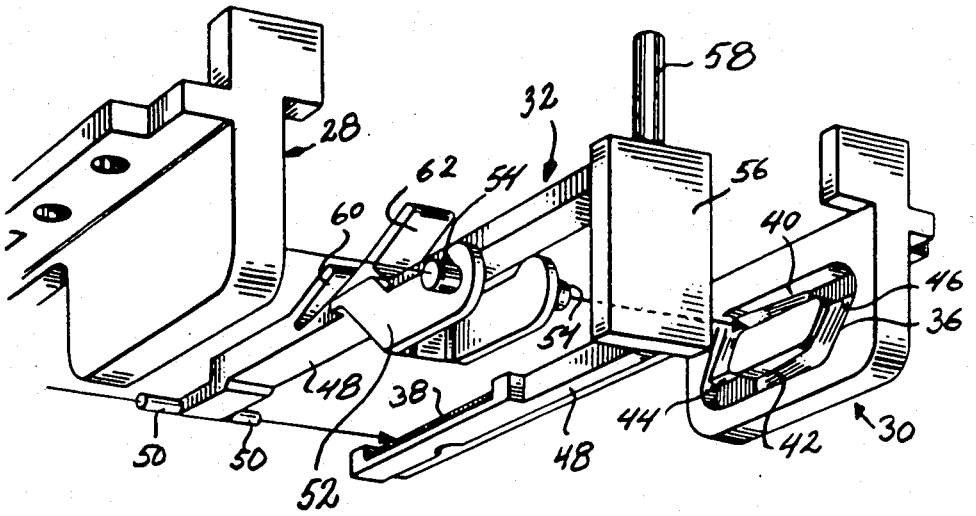

For the purpose of guiding the movement of the feeder 32, in a manner more closely described below, the guide grooves 36 are each formed with two main sections 40, 42 of which the section 40 is formed by the upper and left portions of the parallellogram-shaped guide groove 36, and the section 42 by the lower and right portions (FIG. 2). The bottom of the groove portion 40 rises with an incline which may be of the order of magnitude of 15°, in a direction towards the left portion of the section, there to be terminated by a shoulder 44, via which the section 40 merges into the section 42. The bottom of the section 42 rises in a similar way with an incline which may be of the order of magnitude of 15°, in the opposite direction from the shoulder 44 to a shoulder 46, from which the section 40 departs. From what has now been said it should be clear that the distance between the bottoms of the opposing guide grooves 36 in the side pieces 28 and 30 is least at the tops of the shoulders 44 and 46 and greatest at their feet.

The feeder 32 includes an elongate bar-like central body 48. At its left end this body 48 carries laterally projecting pins 50 intended for rectilinear guidance in the respective one of guide grooves 38. Between its ends the body 48 carries a fork-like projection 52, the projective parts of which each carries a laterally projecting guide pin 54. The pins 54 engage with the respective guide groove 36. The projective parts of the fork-shaped projection 52 are laterally resilient in the direction of the pins 54.

At its right end the bar-like body 48 carries an operating element 56 downwards and an upstanding pin 58. The pin 58 has a form and cross-section such that it is insertable into engagement with the holes in the edge hole row of a printing medium which is to be advanced by the tractor mechanism. On its upper side the body 48 carries two resilient tongues 60 and 62 directed obliquely towards the pin 58 and extending into the path of movement of the teeth 10 via the slot 27 in the lid 25. The distance between the ends of the tongues 60 and 62 is equal to the pitch of the teeth 10, and the distance between the tip of the tongue 62 and the pin 58 is equal to three tooth pitches.

In order to cooperate with the bottoms of the guide grooves 36 the distance between the free ends of the guide pins 54 has a length lying between the lengths of the greatest and least distances between the bottoms of the two guide grooves 36. The resiliency of the fork-like projection 52, however, is such that the pins 54 can pass the shoulders 44 and 46 via the rise of the groove sections 40 and 42, but are prevented by said shoulders 44 and 46 from moving in the opposite direction passing the shoulders. In other words, the guide pins 54 may only move along the guide grooves 36 in one direction which is anticlockwise when observing the groove 36, visible in the side piece 30 on the drawing.

The device described above functions in the following manner for feeding the holed edge of a printing medium into the described tractor mechanism. With the feeder 32 pulled out as far as possible from the holder 2, the pins 54 being then situated at the beginning of the groove section 40, the holed edge of the printing medium is inserted in the direction of the arrow in FIG. 1 into the gap 14 so far that at least the first hole in the row is well inserted into the gap, and such that a following hole can cooperate with the pin 58. The same operation naturally takes place at the other of the two tractor mechanisms of the printer. Beginning with the tongue 60, the tongues 60 and 62 will each be in engagement at the same time with a tooth 10. With operation from the keyboard of the printer, the drive shaft for the belt 8 is put into rotation, and thus the belt 8 into movement in the advancing direction for the printing medium. The teeth 10 then carry the tongues 60 and 62, and thereby the feeder 32 in the direction of the arrow in FIG. 4, so that the feeder engaging with its pin 58 with the printing medium pushes the medium into the tractor mechanism. The pins simultaneously move towards the shoulders 44 and towards the end of their movement along the groove section 40 for the feeder 32 with a movement pivoting around the pins 50 so that the tongues 60 and 62 are moved free from the teeth 10 and the pin 58 is moved out of engagement with the hole in the printing medium. The pins 54 are finally pressed in between the tops of the shoulders 44 to come behind them in the groove sections 42. FIG. 4 illustrates the position of the feeder 32 just before its pivoting movement away from the printing medium.

As previously mentioned, the tongues 60 and 62 are resiliently yielding. This has the advantage that in case of driving the belt 8 in the opposite direction they cannot prevent this movement but yield when the teeth 10 come against them if the feeder should be in a position such that the tongues engage in the movement path of the teeth.

I claim:

1. Device in tractor mechanisms for paper traction feed printers and typewriters, such a mechanism including an endless belt (8) in a holder (2), the belt being mounted for movement in its endless direction, as well as a drive connection for the belt, which belt has external teeth (10) intended for driving a printing medium such as a paper web or the like through the printer on movement of the belt, by engagement with a row of holes along an edge of the medium, the holed edge and the toothed belt running in a gap (14) defined by two wall portions (18, 22) of the holder, the height of the gap being less than the height of the teeth (10) plus the thickness of the belt, the wall portion facing towards the teeth having a groove (26) for the teeth, characterized in that the holder (2) carries a printing medium insertion means with a feeder (32) movable independent of the two wall portions, said feeder movable from an extended printing medium engagement position, in which a hole arrangement means (58) carried by the feeder is brought into engagement with a part of the row of holes in the printing medium intended for insertion in the gap (14), is movable together with the printing medium to a drawn-in position in which a plurality of holes in the row of holes are brought into engagement with teeth (10) in the gap (14), there being moving means (36, 54) carried by the holder and disposed in association with the drawn-in position to move the hole engagement means (58) out of engagement with the row of holes.

2. Device as claimed in claim 1, characterized in that the feeder (32) also carries a carrier means (60, 62) intended for engagement against the teeth (10) when moving into the drawn-in position.

3. Device as claimed in claim 1, characterized in that said carrier means (60, 62) is resilient such as to yield on contact with the teeth (10) if there should be movement of the teeth relative to the feeder opposite a direction of driving of the printing medium through the printer.

4. Device as claimed in claim 3, characterized in that said carrier means comprise at least one tongue (60, 62) which is directed obliquely into the gap (14) in a direction towards the hole engagement means (58).

5. Device as claimed in claim 1 characterized in that said moving means (36, 54) includes cam means arranged to give the feeder (32) a movement, at the end of its movement towards the drawn-in position, from a first level corresponding to the gap (14) to a second level relative thereto at which the feeder (32) is moved out of engagement with the printing medium when the printer is in operation.

6. Device as claimed in claim 5, characterized in that said cam means is also adapted to allow movement of the feeder (32) into said extended printing medium engagement position only from said second level.

7. Device as claimed in claim 6, characterized in that said cam means includes a guide pin (54) on the feeder (32) projecting laterally at least on one side of the feeder, and a corresponding parallellogram-shaped guide groove (36) in a side wall (30) extending at least partially along the extent of the feeder, the pin (54) being in engagement with said guide groove (36), said level being determined by the parallellogram side situated furthest away from the gap (14).

8. Device as claimed in claim 7, characterized in that a laterally projecting guide pin (54) and corresponding parallellogram-shaped guide grooves (36) are disposed on either side of the feeder (32) and that in each guide groove (36) the bottom of the groove section (40 and 42) which is nearest and furthest away, respectively, from the gap (14) rises in a direction from and to, respectively, the hole engagement means (58) to be terminated by a shoulder (44 and 46) down towards the bottom of the respective second groove section (40 and 42), the pins (54) being resiliently arranged in their longitudinal direction and the distance between their free ends being greater than the least distance between the bottoms of both parallellogram-shaped guide grooves (36), i.e. at the shoulders (44, 46).

9. Device as claimed in claim 5, characterized in that said cam means includes a guide pin (54) on the feeder (32) projecting laterally at least on one side of the feeder, and a corresponding parallellogram-shaped guide groove (36) in a side wall (30) extending at least partially along the extent of the feeder, the pin (54) being in engagement with said guide groove (36), said level being determined by the parallellogram side situated furthest away from the gap (14).

10. Device as claimed in claim 9, characterized in that a laterally projecting guide pin (54) and corresponding parallellogram-shaped guide grooves (36) are disposed on either side of the feeder (32) and that in each guide groove (36) the bottom of the groove section (40 and 42) which is nearest and furthest away, respectively, from the gap (14) rises in a direction from and to, respectively, the hole engagement means (58) to be terminated by a shoulder (44 and 46) down towards the bottom of the respective second groove section (40 and 42), the pins (54) being resiliently arranged in their longitudinal direction and the distance between their free ends being greater than the least distance between the bottoms of both parallellogram-shaped guide grooves (36), i.e. at the shoulders (44, 46).

* * * * *